US006495953B1

(12) United States Patent
Imura

(10) Patent No.: US 6,495,953 B1
(45) Date of Patent: Dec. 17, 2002

(54) COLD CATHODE ELECTRON GUN

(75) Inventor: Hironori Imura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/386,966

(22) Filed: Aug. 31, 1999

(30) Foreign Application Priority Data

Sep. 1, 1998 (JP) ..... 10-247201

(51) Int. Cl.[7] ..... H01J 29/46
(52) U.S. Cl. ..... 313/448; 313/446; 315/3.5
(58) Field of Search ..... 313/448, 495, 313/496, 497, 306, 307, 308, 309, 441–460; 315/169, 169.1, 3.5, 5, 5.33

(56) References Cited

U.S. PATENT DOCUMENTS

| | | | | |
|---|---|---|---|---|
| 3,753,035 A | * | 8/1973 | Veith | 315/31 R |
| 3,999,072 A | * | 12/1976 | Takagi | 250/427 |
| 4,914,724 A | * | 4/1990 | Chevalier et al. | 315/382 |
| 5,218,443 A | * | 6/1993 | Ricaud et al. | 358/223 |
| 5,604,401 A | * | 2/1997 | Makishima | 315/3 |
| 5,633,507 A | * | 5/1997 | Pfeiffer et al. | 250/492.23 |
| 6,114,808 A | * | 9/2000 | Takahashi | 315/3.5 |

FOREIGN PATENT DOCUMENTS

| | | |
|---|---|---|
| JP | 6-36681 | 2/1994 |
| JP | 8-106848 | 4/1996 |
| JP | 10-106430 | 4/1998 |

OTHER PUBLICATIONS

Schwoebel, et al., "Surface–science aspects of vacuum microelectronics", J. Vac. Sci. Technol. B 13(4), Jul./Aug. 1995.

* cited by examiner

*Primary Examiner*—Ashok Patel
*Assistant Examiner*—Mariceli Santiago
(74) *Attorney, Agent, or Firm*—Sughrue Mion, PLLC

(57) ABSTRACT

To stabilize an emission current of cold cathode electron gun and extend its product life. A cold cathode electron gun comprises a cold cathode for emitting electrons by field-emission, a gate electrode for controlling the field-emission, a Wehnelt electrode which surrounds the cold cathode and the gate electrode, a first anode for accelerating electrons, and a second anode for constructing an electron lens together with the first anode. An inner diameter of the first anode is greater than a radius of flow of electrons which are emitted in the direction perpendicular to the optical axis of the electron lens.

5 Claims, 8 Drawing Sheets

COLD CATHODE ELECTRON GUN

BACKGROUND OF THE INVENTION

1. Field of the Invention

The present invention relates to a cold cathode electron gun, such as a field emitter array, which can supply a stable electron flow for a long time period by avoiding collisions of electrons against an inner wall of anode.

2. Description of the Prior Art

So far, designing methods concerning hot cathode electron gun have been applied also for designing structures of anode of cold cathode electron guns.

For example, in case of a traveling wave tube, a value of electron current, a radius of electron beam in a slow wave circuit, an inner diameter of helix, a pitch of the helix must be decided on the basis of a product specification such as operating frequency and output power. The radius of electron beam, for example, is set to be about 60% of the inner diameter of helix, taking into consideration manufacturing factors such as a degree of off-axis between the electron lens and the slow wave circuit, and a distortion and curvature of the helix.

In the hot cathode electron gun, the value of electron current is put to be a value of $V^{3/2}$ multiplied by a perveance which is decided on the basis of shapes of cathode, anode and Wehnelt near the cathode. Here, V is an anode voltage.

Then, on the basis of the decided value of current, the radius of electron beam is calculated by tracking the electrons. Further, shapes of the electrodes are decided to introduce electron beam into the slow wave circuit.

The above-mentioned designing procedures are employed with minute modifications for the cold cathode electron gun.

Some modifications in the designing are necessary, because electrons are emitted with an initial velocity and a divergence angle.

For example, Spindt type cold cathode comprises a cone emitter, and a gate which is provided with a hole which surrounds the pointed end of the cone. Electrons are emitted from the pointed end of the cone by the field-emission under the application of voltage of several tens V to about a hundred V between the emitter and the gate.

Therefore, the electron emitted from the above-mentioned cold cathode has an initial velocity corresponding to the applied voltage, while the initial velocity of the electron emitted from the hot cathode is equivalent merely to thermal energy usually smaller than 1 eV or several eV at most.

Further, in the Spindt type cold cathode, electrons are emitted not only from the pointed end of the cone, but also from micro projections formed on the surface of the cone. Therefore, the emitted electron beam has a divergence angle, because the electric field near the pointed end of the cone is great enough to emit electrons by the field-emission.

The divergence angle indispensable for the electron beam tracing is reported to be 25° to 30° by P. R. Schwoebel and I. Brodie, in J. Vac. Sci. Technol. B 13 (4) 1391, 1995.

Thus, it is assumed that the emitted electron has an initial velocity of several tens eV and a divergence angle of 25° to 30°, in the electron beam tracing in the electron lens of the cold cathode electron gun and RF circuit such as the slow wave circuit of the traveling wave tube or a resonance cavity of klystron.

An electron gun of which electron flow is stabilized is disclosed for example in JP 10-106430 A (1998). The cold cathode electron gun as shown in FIG. 10, gate electrodes 100 surrounding emitters and cathode electrodes 101 are divided into a plurality of groups. Electrons are extracted from focus electrode 102 at a constant value of current by compensating the surface condition of pointed end of the emitters.

Further, another cold cathode electron gun disclosed in JP 8-106848 A (1996) avoids the collision of electrons against the side wall of focus electrode 13. This cold cathode electron gun as shown in FIG. 11 comprises substrate 14, emitter 15, cathode 11, extracting electrode 12, and focus electrode 13. Insulating film **16*b* between extracting electrode 12 and focus electrode 13 is over-etched to reduce the width of focus electrode 13** and to avoid the electron collision.

However, the conventional designing procedures for the cold cathode electron gun are not consistent, because merely the design method for the hot cathode is diverted, wherein the initial velocity of the emitted electron is negligibly small.

Further, the emission current decreases after long term operation of the cold cathode electron gun which is designed by the conventional method.

SUMMARY OF THE INVENTION

Therefore, an object of the present invention is to stabilize the emission current of the cold cathode electron gun in a long term operation.

A cold cathode electron gun of the present invention comprises: a cold cathode for emitting electrons by field-emission; a gate electrode for controlling the field-emission; a Wehnelt electrode which surrounds the cold cathode and the gate electrode; a first anode for accelerating electrons; and a second anode for constructing an electron lens together with the first anode. In the cold cathode electron gun of the present invention, an inner diameter of the first anode is made greater than a radius of flow of electrons which are emitted in the direction perpendicular to the optical axis of the electron lens.

According to the present invention, the emission current is maintained at the initial value for a long period.

Further, according to the present invention, a product life of the electron gun is extended, because contamination of emitter is reduced.

PREFERRED EMBODIMENT OF THE INVENTION

Figure 1:
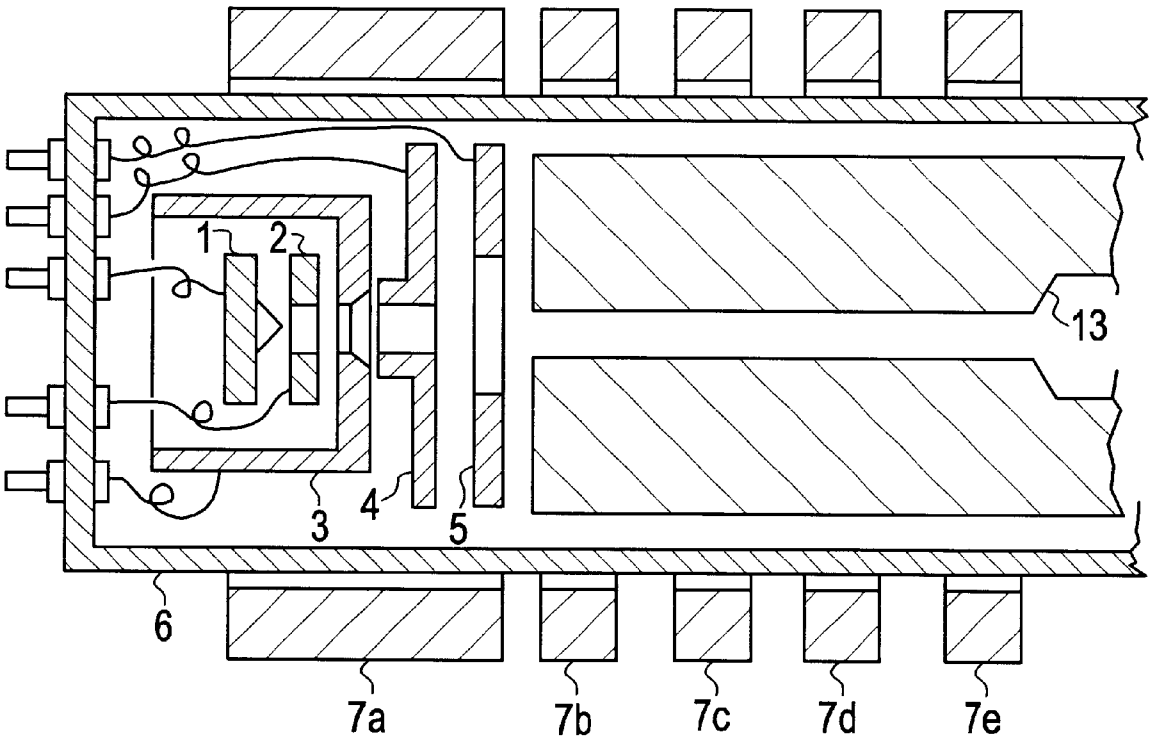
FIG. 1 is a cross sectional view of an electron gun of the present invention.

Modes of embodiment of the present invention are explained, referring to the drawings.

A cross sectional view of the cold cathode electron gun of the present invention is shown in FIG. 1. As shown in FIG. 1, the cold cathode electron gun of the present invention comprises cold cathode 1 for emitting electrons by the field-emission, gate electrode 2 for controlling the field-emission, Wehnelt electrode which surrounds cold cathode 1 and gate electrode 2, first anode 4 for accelerating the electrons, second anode 5 which constructs an electron lens together with first anode 4. This electron gun is contained in vacuum envelope 6 of, for example, a traveling wave tube. Further, a plurality of magnets 7*a*, 7*b*, 7*c*, 7*d*, 7*e* are arranged around a slow wave circuit.

The divergence angle of the electron beam emitted from the cold cathode is 25° to 30° as mentioned above. Further, according to the inventor's experiment, 97.5% of the total current is contained in this divergence angle, while the rest diverges at the angle greater than 30°. The maximum divergence angle was found to be 90°.

Therefore, 2.5% of the total electron beam with the divergence angle of 30° to 90° collide with first anode and second anode which are placed near cold cathode 1, when the electron gun is designed by the conventional method. The collision causes out-gas around the first anode 4 and second anode 5 to generate positive ions. Then, the positive ions collide with cold cathode 1. As a result, cold cathode 1 is contaminated, and the emission current decreases.

The present invention has been completed on the basis of a discovery as mentioned above.

It is necessary to trace electrons to decide structures and characteristics of an electron gun.

Conditions imposed upon the electrons emitted from hot and cold cathode are as follows:

In case of the hot cathode, the emission current is decided to be a value of $V^{3/2}$ multiplied by a perveance which is decided on the basis of the Langmuir-Child law. The initial velocity of the emitted electron is nearly 0. Further, the emision direction is along the electric field on the surface of the hot cathode. The anode for accelerating the electrons is opposed to Wehnelt of which electric potential is usually made equal to that of the cathode.

On the other hand, in case of the cold cathode comprising a cone emitter and a gate electrode, electrons are emitted from the pointed end of cone emitter by the strong electric field between the emitter and the gate. The initial velocity of the emitted electron is a value corresponding to the voltage applied to the gate electrode, and the divergence angle of the emitted electron is 25° to 30° as reported by P. R. Schwoebel and I. Brodie, in J. Vac. Sci. Technol. B 13 (4) 1391, 1995. Thus, the electrons emitted from the cold cathode passes through inside the electron gun with such an initial velocity and divergence angle.

The above-mentioned initial velocity and divergence angle are inputted as initial parameters in the electron tracing.

Figure 2:
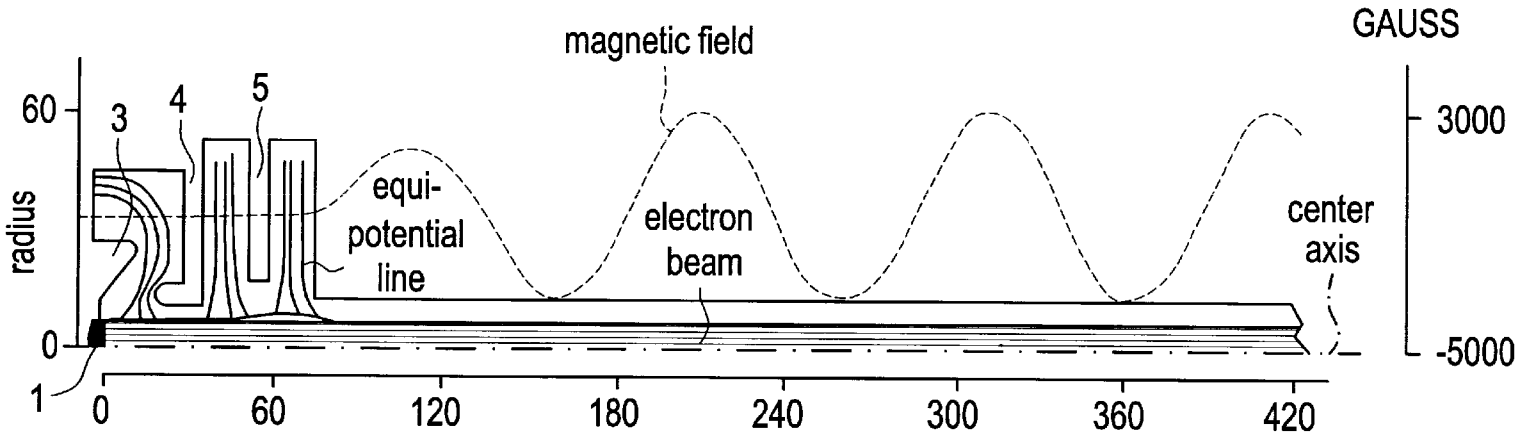
FIG. 2 is an illustration for indicating an example of calculation of electron beam tracing.

An example of the tracing result is shown in FIG. 2. As shown in FIG. 2, the inner diameter is designed to be great enough to avoid electron collision. At the same time, the inner diameter is made small enough to reduce the applied voltage to obtain optimum electric field affecting the electron flow. As a result, breakdown voltages between electrodes become less important.

Actually, the current and radius of the electron beam are decided at first, for example, in a slow wave circuit of the traveling wave tube. Then, the electron beam tracing is executed to obtain the above-mentioned electron beam under a prescribed divergence angle such as 25° and a prescribed initial velocity corresponding to the voltage applied between the gate and emitter.

Further, the structure and size of the first anode and second anode are designed as follows.

The electron beam tracing is executed under the divergence angle of 90° and the initial velocity corresponding to the voltage applied between the emitter and gate, to guarantee that the anode be outside the outmost orbit of the electron beam.

In designing the cold cathode electron tube, the designing of the electron gun is separated from the designing of the tube characteristics concerning the slow wave circuit of the traveling wave tube, or the resonance cavity of klystron.

Concretely, the designing of the electron gun under the 90° divergence is executed after the designing of tube characteristics under the 25° to 30° divergence, repeatedly to obtain the optimum structure. The iteration procedure is necessary, because any variation in the position and radius of the anodes in the designing of the electron gun affects in turn the trajectories of electrons in the slow wave circuit, or resonance cavity in the designing of the tube characteristics.

Figure 3:
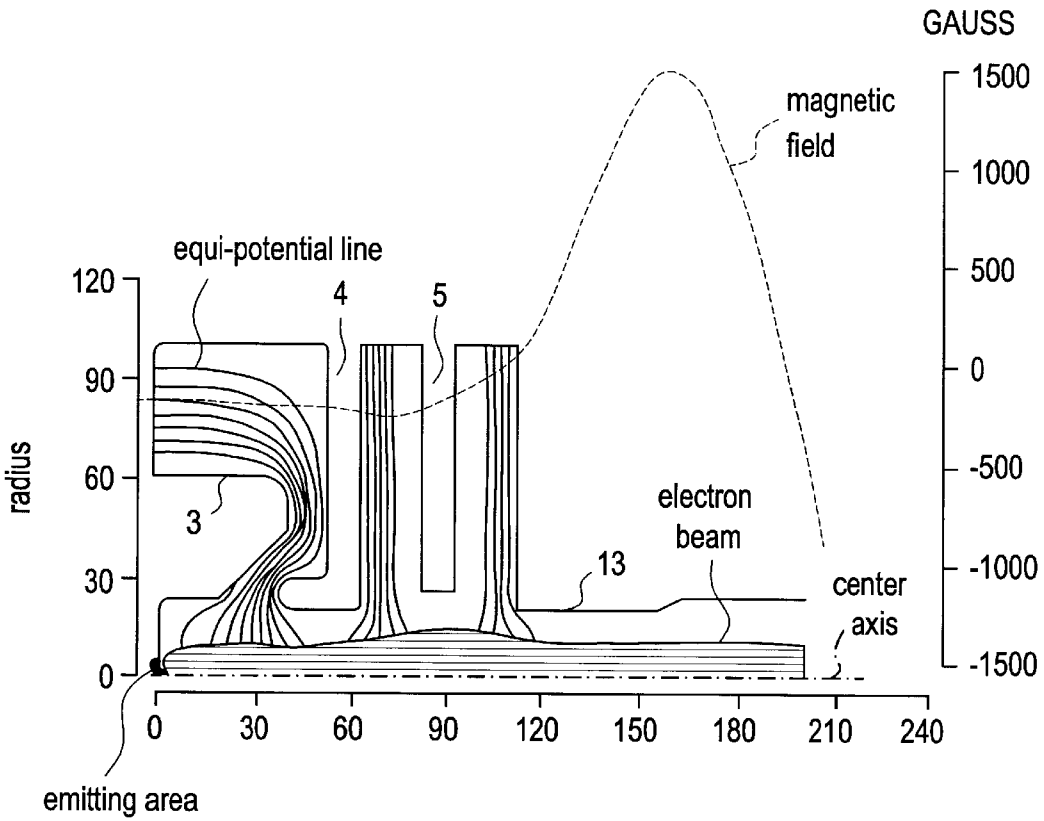
FIG. 3 is an illustration for indicating an example of electron beam near the anodes.

A result of designing of 30 GHz traveling wave tube (TWT) is shown in FIG. 3. The diameter of an emitting area in the cold cathode 1 is set to be 0.6 mm. Wehnelt electrode 3 and gate electrode 2 have the same electric potential. The emission current of 40 mA is obtained by applying 70 V between gate electrode 2 and emitter. The voltage applied to first anode 4 is 6 kV to extract and accelerate the emitted electrons. Further, second anode 5 of which electric potential is the same as that of Wehnelt electrode 3 constructs an electron lens on the basis of a potential difference between first anode 4. Thus, the electrons are introduced into slow wave circuit 13, without being diverged. The voltage applied to slow wave circuit 13 is 4.7 kV.

A pattern of the magnetic field by the magnets arranged around the slow wave circuit 13 is also shown in FIG. 3. The horizontal axis is the center axis of the electron tube. The numbers of the left vertical axis and the horizontal axis are numbers of meshes of which unit is 0.05 mm. The right vertical axis indicates the magnetic field in Gauss. The divergence angle is set to be 25°.

Figure 4:
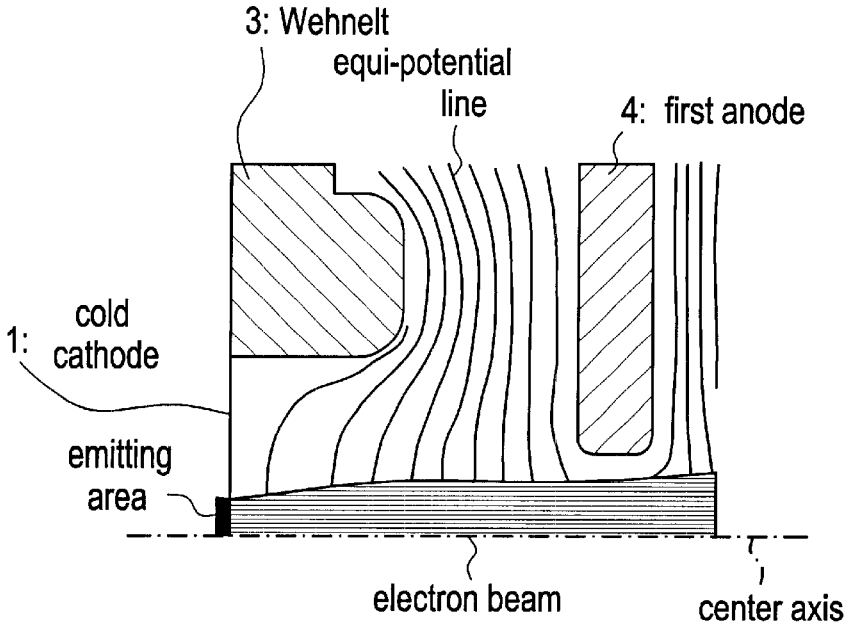
FIG. 4 is an illustration for indicating an example of tracing of electron emitted at 25°.

Further, the flow of electrons and the equi-potential lines near first anode 4 under the 25° divergence are shown in FIG. 4.

The inner diameter of first anode 4 as shown in FIG. 3 is 1.8 mm, which is a size for avoiding the collision of electron emitted at the 90° divergence.

Figure 5:
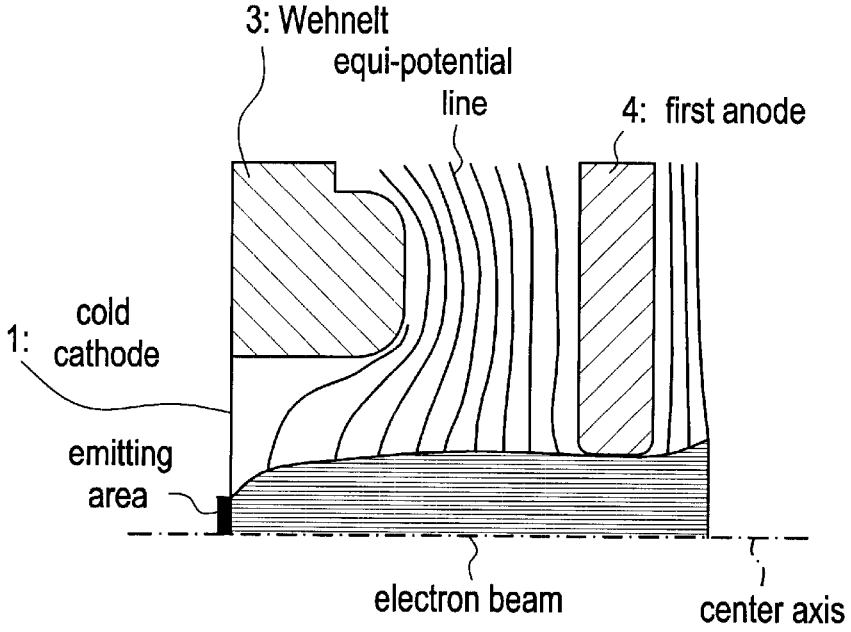
FIG. 5 is an illustration far indicating an example of tracing of electron emitted at 90°.

Furthermore, the flow of electrons and the equi-potential lines near first anode 4 under the 90° divergence are shown in FIG. 5.

The inner diameter of first anode 4 may be greater than 1.8 mm, when the electron beam requirement is satisfied in the slow wave circuit, and the voltage between Wehnelt electrode 3 and first anode 4 is smaller than the breakdown voltage.

The electron gun of the present invention as explained above is designed on the basis of the electron beam tracing under the divergences of 25° and 90°. The electrons emitted from the cold cathode do not collide with first anode 4, because the inner wall of first anode 4 is located outside the electron trajectory of 90° divergent electron. Therefore, the ion bombardment against cold cathode 1 is avoided, and the electron emission from cold cathode 1 is stabilized.

In the above explanation, it is assumed that 97.5% of the total current is contained in the divergence angle of 25°, and the rest 2.5% is distributed between 25° and 90°.

The output of electron tube is affected greatly by a distance between an electron and helix which accepts electron energy and amplifies RF signal in the slow wave circuit of the TWT. The amplification becomes efficient, when the distance between the helix and electron is small. This is because the electron energy is transferred to the helix more frequently. Therefore, the electron flow within the 25° divergence must be located at the optimum position in the helix in the slow wave circuit. Further, when the anode voltage is high in the order of several kV, molecules adsorbed on the surface of the anode come out from the surface by the electron collision. The out-gas molecules are further ionized by the electron collision.

Then, the ionized molecules are accelerated toward the cold cathode, where a part of the ionized molecules collides with the electron emitter. As a result, the electron emission decreases due to adsorption of molecules on the surface of the emitter, or a deformation of the surface of the emitter. Therefore, the electron emitted at 90° must not collide at all with the anode.

A part of the electrons with the divergence greater than 25° may collide with the helix in the slow wave circuit. However, the ions generated in the helix can not reach the anode, because the electric potential of first anode 4 is set higher than that of the slow wave circuit. Further, the trajectory of electron emitted at 90° from the cold emitter to the anode of which electric potential is the highest in reference to the cold cathode is enough to optimize the designing.

By the above-mentioned method of designing, a stabilized emission of electron is guaranteed for along period of time in the cold cathode electron gun of the present invention.

Figure 6:
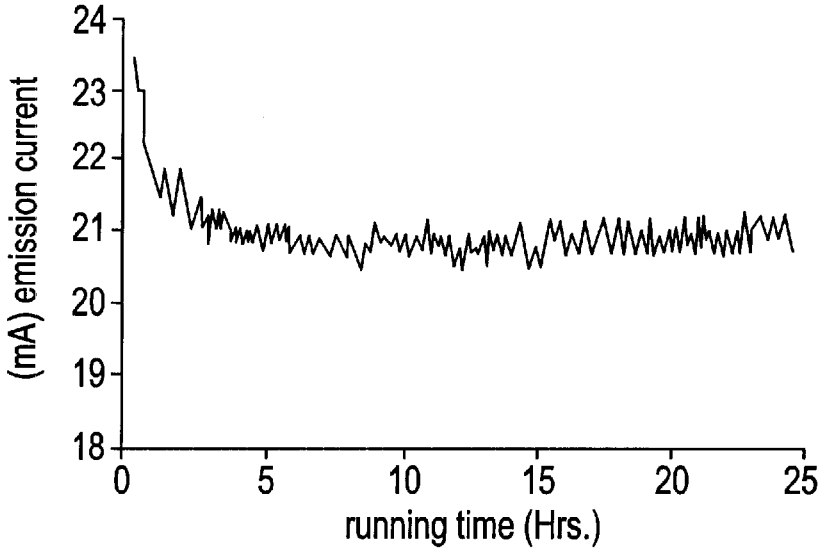
FIG. 6 is a graph indicating emission current in a running test of electron gun, wherein the inner diameter of first anode is 1.5 mm.
Figure 7:
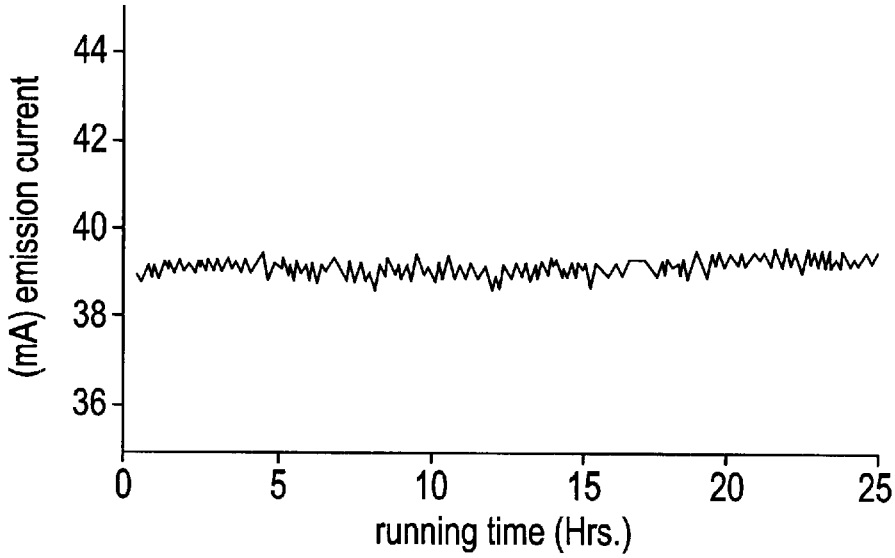
FIG. 7 is a graph indicating emission current in a running test of electron gun, wherein the inner diameter of first anode is 2 mm.
Figure 8:
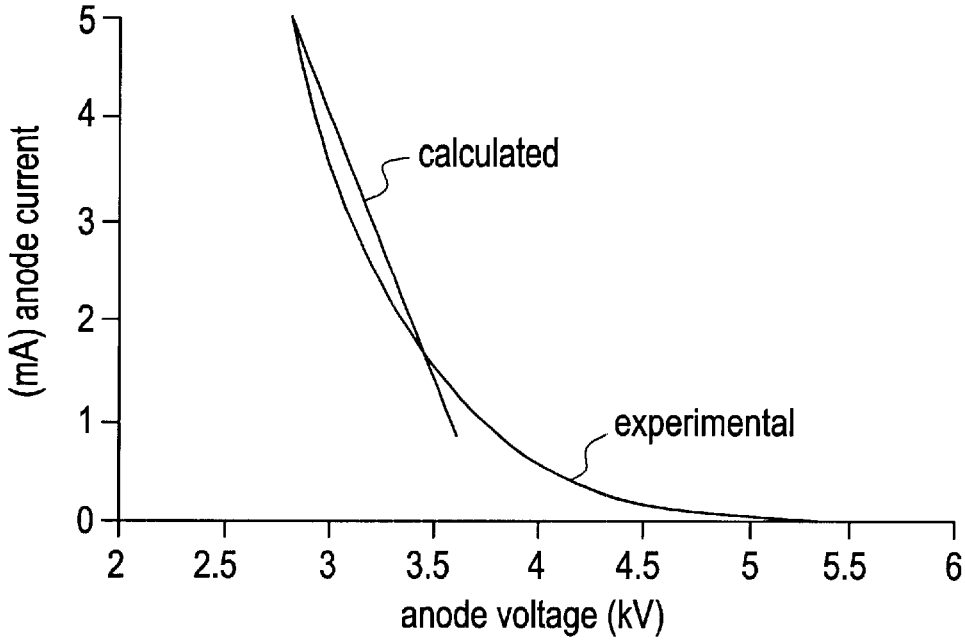
FIG. 8 is a graph showing the relation between anode current and anode voltage.

Next, an example of evaluation in a running test over a period longer than twenty hours is explained, referring to FIGS. 6, 7, and 8. A specification of emission current of the test tube is 35 mA or more.

The test result as shown in FIG. 6 is that of the test tube which was designed only on the basis of the trajectory of electron emitted at 25°. The test tube has 25 million emitter cones. The inner diameter of first anode 4 is 1.5 mm. Further, gate voltage is 65 V, and first anode voltage is 7 kV. The design is such that electron does not collide at all with first anode 4 even at the emission current of 35 mA.

Actually, in the test result as shown in FIG. 6, the initial emission current of 23 mA decreases to 21 mA after several hours, although thereafter the emission is stabilized. When the emission current is raised again to 23 mA or more, the emission current decreases to 21 mA after several hours, and then maintains 21 mA. Further, 23 mA emission can never be recovered, although the emission is stabilized to 21 mA for the same gate voltage of 65 V.

Therefore, the inventor prepared a tube with another first anode, although the cold cathode is the same as that of the test tube which was used in the experiment as shown in FIG. 4.

The inner diameter of first anode of the tube used in the experimental result as shown in FIG. 7 is 2 mm. As shown in FIG. 7, the in initial emission current of 39 mA is maintained after 20 hours or more.

According to the inventors calculation of electron trajectories, the electron flow emitted at 25° and at 39 mA has 2 mm diameter at the entrance of first anode 4.

Therefore, the tube with 2 mm diameter anode satisfies the designing criteria for both of the 25° and 90° emissions.

Now, the reason why the decreased emission current is stabilized as shown in FIG. 6 is explained.

The main reason why the initial emission current decreases is because of the fact that a part of the emitted electrons collides with the anode. The out-gases by this collision are further ionized by electrons, and are accelerated toward the emitter. A part of the positive ions, then, collides with the emitter.

Therefore, the emission current decreases due to the destruction of the emitter surface, or due to some increase in the work function caused by the gas adsorption on the emitter surface.

Next, an effect of the electron of which divergence angle is greater than 30° is explained, referring to FIG. 8.

An anode characteristic was measured as shown in FIG. 8. Here, the anode current is a current which flows into the anode, when the anode voltage is varied under the constant emission current of 40 mA. A part of the current which does not flows into the anode intrudes into the slow wave circuit.

In general, electron beam tends to widen due to the repulsive force between electrons as space charges. Therefore, the lower the anode voltage is, the wider the electron beam becomes, because it takes much time to reach the anode, when the acceleration is small, due to the low voltage. Accordingly, the anode current increases, when the anode voltage decreases.

An anode current is calculated for the 25° emission, as shown in FIG. 8.

The component of the anode current which lies over the calculated line as shown in FIG. 8 comes from electrons emitted at the angle greater than 25°, because the greater the beam divergence is, the greater the anode current becomes.

The actual divergence angle is estimated to be slightly greater than 25°, on the basis of the measurement in the region of the anode voltage greater than 3.5 kV which corresponds to the anode current of 1.5 mA.

Nevertheless, one of the designing criterion can be adopted at the 25° emission on the basis of the fairy good consistency between the theory and experiment as shown in FIG. 8.

The anode current is smaller than a detection limit of 10 $\mu$A, when the voltage applied to first anode 4 is 7 kV in the tube used for the running test as shown in FIG. 6 which was designed by the conventional method. However, a part of the emission current possibly flows into the anode.

The outmost trajectory of electron can be confirmed by the trajectory calculation to be coincide with the inner wall of first anode, under the assumptions that the emission angle is 90° in the structure as shown in FIG. 3, and that the emission current is stabilized after several hour running as shown in FIG. 6 is 21 mA.

Accordingly, if the trajectory of the electron emitted at 90° is taken into consideration, any electrons from the cold cathode can not collide at all with first anode 4, by designing an electron gun such that the electron beam component emitted at 90° does not collide with the anode.

On the other hand, in case of hot cathode electron gun, the trajectory of the electron emitted at 90° is almost the same as that of the electron emitted at 0°, because the initial velocity of the thermal electron is nearly zero, although such a calculation reveals that the emission of thermal electron is isotropic, irrelevant to the anode voltage, and that the trajectory is perturbed due to the space charge effect near the hot cathode.

The Wehnelt electrode 3 may have the same potential as cold cathode 1, although Wehnelt electrode 3 has the same potential as second electrode 5 in the above explanation.

Figure 9:
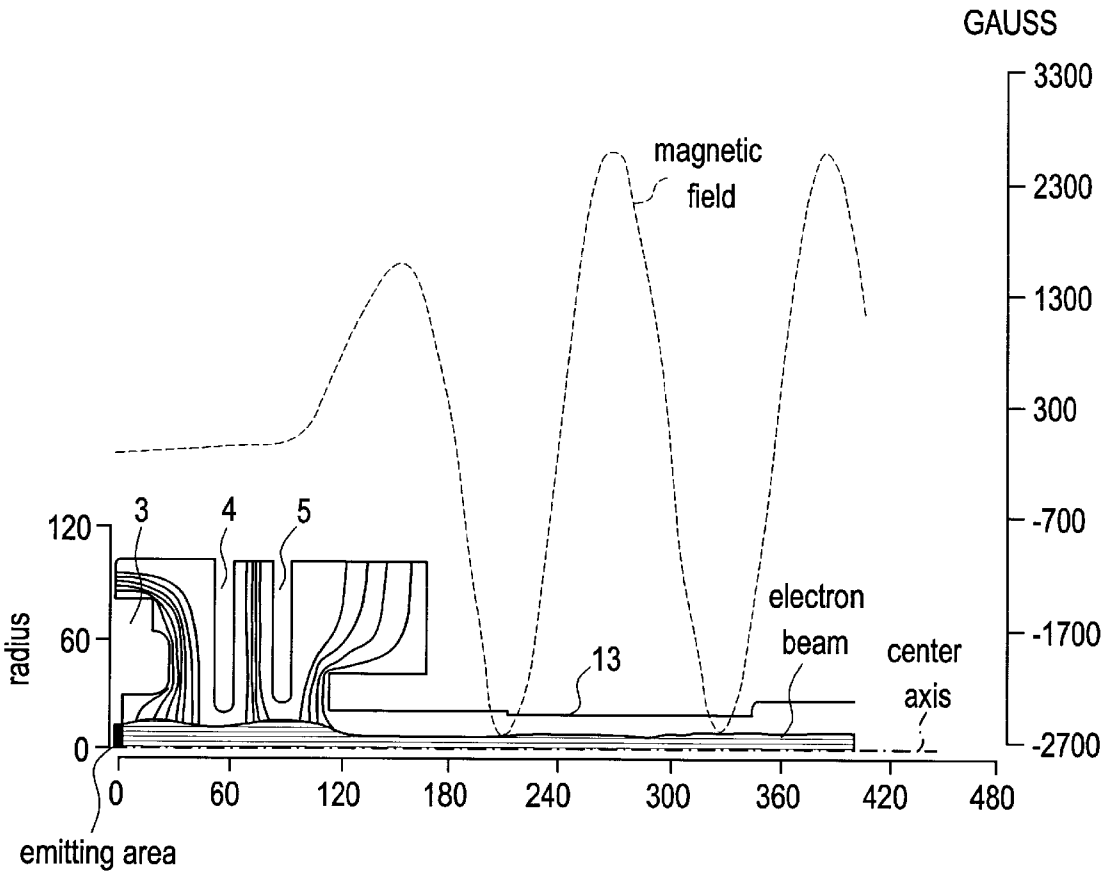
FIG. 9 is an illustration for indicating an example of electron beam near the anodes in another mode of embodiment of the present invention.
Figure 10:
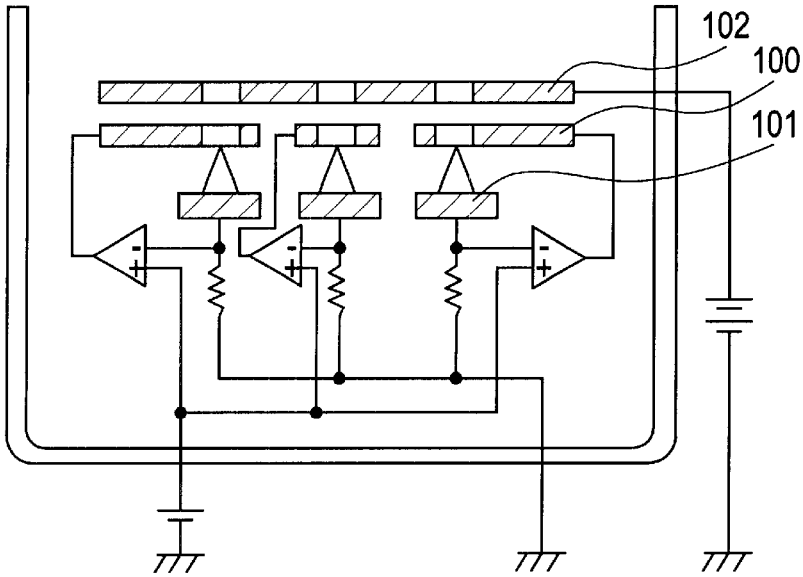
FIG. 10 PRIOR ART
FIG. 10 is a cross sectional view of a conventional electron gun as disclosed in JP 10-106430 A (1998).
Figure 11:
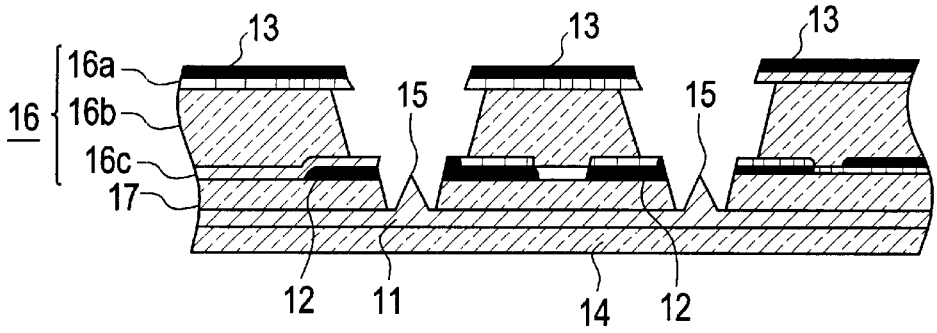
FIG. 11 PRIOR ART
FIG. 11 is a cross sectional view of another conventional electron gun as disclosed in JP 8-106848 A (1996).

A calculation result of the electron beam tracing in an X band (8/7 GHz) TWT electron gun wherein Wehnelt electrode and gate electrode 2 have the same electric potential is shown in FIG. 9. The emission area of cold cathode 1 is 1.2 mm, and an emission current of 40 mA is obtained by applying 60 V between gate electrode 2 and emitter. 7 kV is applied to first anode 4 for extracting and accelerating the electrons emitted from the emitting area of cold cathode 1. Further, second anode 5 as a part of an electron lens for introducing the emitted electrons into the slow wave circuit 13 to which 5 kV is applied.

The magnetic field is also shown in FIG. 9, where the horizontal axis is the center axis of the electron tube, the left vertical axis is directed to the radial axis of the electron tube. Mesh numbers are indicated along the horizontal axis and the left vertical axis. The unit mesh is 0.05 mm. The right vertical axis indicates the magnetic field in Gauss. The emission angle of electron is set to be 25°.

The inner diameter of first anode 4 as shown in FIG. 9 is 2 mm which is sufficient for the electron emitted at 90° not to collide with first anode 4. Therefore, any positive ions which affects the stability of the operation of cold cathode 1 are not generated at all. Further, any ions generated in slow wave circuit 13 can not reach cold cathode 1, because the highest voltage is applied to first anode 4. Therefore, the emission current is stabilized for a long period of time.

The kind of cold cathode is not irrelevant with the designing, wherein the inner diameter of the anode is decided on the basis of the emission angle of electron by the field emission.

What is claimed is:

1. A cold cathode electron gun which comprises:

a cold cathode for emitting electrons by field-emission;

a gate electrode for controlling said field-emission;

a Wehnelt electrode which surrounds said cold cathode and said gate electrode;

a first anode for accelerating said electrons; and a second anode for constructing an electron lens together with said first anode, wherein an inner diameter of said first anode is greater than a maximum radius of flow of said electrons which are emitted in the direction perpendicular to the optical axis of said electron lens.

2. The cold cathode electron gun according to claim 1, wherein a voltage applied to said first anode is greater than a voltage applied to said second anode.

3. The cold cathode electron gun according to claim 1, a voltage applied to said first anode is greater than voltages applied to said second anode, said gate electrode, and said Wehnelt electrode.

4. The cold cathode electron gun according to claim 1, wherein voltages applied to said second anode, said gate electrode, and said Wehnelt electrode are the same with each other.

5. The cold cathode electron gun according to claim 1, which further comprises a slow wave circuit for introducing said electrons which pass through said second anode, wherein a voltage applied to said first anode is greater than voltages applied to said second anode, said gate electrode, said Wehnelt electrode, and the voltage applied to said slow wave circuit.

* * * * *